US007489896B2

(12) United States Patent
Nanjo

(10) Patent No.: US 7,489,896 B2
(45) Date of Patent: Feb. 10, 2009

(54) FIXING DEVICE AND IMAGE FORMING APPARATUS

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 62 days.

(21) Appl. No.: 11/385,456

(22) Filed: Mar. 21, 2006

(65) Prior Publication Data

US 2006/0213896 A1 Sep. 28, 2006

(30) Foreign Application Priority Data

Mar. 25, 2005 (JP) ..... 2005-089175

(51) Int. Cl.
*G03G 15/20* (2006.01)

(52) U.S. Cl. ..... 399/333; 399/330

(58) Field of Classification Search ..... 219/216, 219/600, 619; 399/320, 328–333
See application file for complete search history.

(56) References Cited

U.S. PATENT DOCUMENTS 6,605,802 B2 * 8/2003 Nagahira ..... 219/619
6,795,679 B2 * 9/2004 Shimizu et al. ..... 399/333
2004/0105708 A1 * 6/2004 Imai et al. ..... 399/330

FOREIGN PATENT DOCUMENTS

JP 9-127810 5/1997
JP 2004-151470 5/2004

* cited by examiner

*Primary Examiner*—David M Gray
*Assistant Examiner*—Laura K Roth
(74) *Attorney, Agent, or Firm*—Gerald E. Hespos; Anthony J. Casella

(57) ABSTRACT

A fixing device (30) has a fixing member (30) adapted to be heated by induction heating based on a magnetic field from an induction coil (34). A pressing member (40) is disposed in contact with the fixing member (30) to define therebetween a nip zone (N) for passing a sheet (P) therethrough. The fixing member includes a heating layer (32). The heating layer (32) has a temperature-sensitive metal layer (321) and formed on the side of the induction coil (34), and a nonmagnetic metal layer (322) laminated onto the temperature-sensitive metal layer (321). The nonmagnetic metal layer is made of aluminum as a metal having a low specific resistance, and formed to have a thickness (50 μm) allowing the nonmagnetic metal layer to be substantially free from a temperature rise due to the induction heating.

21 Claims, 7 Drawing Sheets

FIXING DEVICE AND IMAGE FORMING APPARATUS

BACKGROUND OF THE INVENTION

1. Field of the Invention

The present invention relates to an image forming apparatus, such as a copy machine, and a fixing device included therein, and more particularly to a fixing device for fixing a toner image on a transfer target in a manner based on an induction heating technique, and an image forming apparatus using the fixing device.

2. Description of the Related Art

An image forming apparatus is designed to irradiate an outer peripheral surface of a photosensitive drum in a rotating state with an image information-based light beam so as to form an electrostatic latent image on the outer peripheral surface, and supply toner serving as developer to the latent image so as to a toner image. The toner image formed on the outer peripheral surface of the photosensitive drum is transferred onto a sheet serving as a transfer target fed thereto, and then the sheet is subjected to a fixing process based on heating in a fixing device. The sheet after completion of the fixing process is ejected outside from an apparatus body.

Typically, the fixing device comprises a fixing roller adapted to be heated to a high temperature, and a pressing roller disposed opposed to the fixing roller in such a manner that an outer peripheral surface thereof is in contact with an outer peripheral surface of the fixing roller. The fixing process is performed by feeding a sheet into a nip zone defined between the fixing and pressing rollers. Heretofore, a but-in type halogen lamp has been employed as a heating source for the fixing roller. The halogen lamp has problems about poor thermal efficiency, and slow response (or low heat-up speed) requiring a fairly long time-period in a warming-up (initial heating) stage. While various techniques for achieving reduction in heat capacity and wall thickness of the fixing roller have been developed as measures against these problems, such approaches have limitations for themselves.

Recent years, great interest has been shown in an induction heating-type fixing device designed to heat a fixing roller based on an induction heating technique, as disclosed in Japanese Patent Laid-Open Publication No. 09-127810. In this induction heating-type fixing device, the fixing roller comprises a hollow roller made of a nonmagnetic metal having excellent heat conductivity, and a thin layer formed on an outer peripheral surface of the hollow metal roller and made of a magnetic metal. The fixing device is provided with an induction coil within the fixing roller, and designed to energize the induction coil so as to produce an eddy current in the magnetic metal layer and heat the fixing roller based on Joule heat generated by the eddy current.

As compared with the conventional halogen lamp-type fixing device, the induction heating-type fixing device allows the fixing roller to be heated up at a drastically increased speed so as to achieve a higher-speed warm-up of the fixing roller. On the other hand, the extremely high heat-up speed raises a new problem about excessive heating of the fixing roller. In order to solve this problem, it is contemplated to employ a feedback control for detecting a temperature of the fixing roller using a temperature sensor, such as a thermistor or a thermostat, and cutting off a power supply to the induction coil when the fixing roller is heated up to a predetermined temperature or more. However, the temperature sensor has difficulty in outputting a detection signal accurately in response to a temperature rise arising from the induction heating, and this time-lag or detection delay is likely to preclude prevention of excessive heating of the fixing roller.

Generally, heat transfer in a longitudinal direction of a fixing roller is apt to become harder as the fixing roller is reduced in wall thickness. Thus, when a sheet having a width less than a heating width of the fixing roller is continuously passed through the fixing roller (or a nip zone), heat tends to stay and accumulate at the opposite end regions of the fixing roller that a smaller number of sheets pass. In this state, if wider sheets are subjected to a fixing process, the accumulated heat will cause image defects, such as a so-called offset phenomenon that a toner image on one of the wider sheets is fusion-bonded onto the end regions of the fixing roller and then transferred onto the next wider sheet.

In order to solve this problem, Japanese Patent Laid-Open Publication No. 2004-151470 (hereinafter referred to as Document D2) discloses an induction heating-type fixing device comprising a fixing roller which includes a tubular-shaped temperature-sensitive-metal layer made of a temperature compensator alloy, a nonmagnetic metal layer formed on an outer peripheral surface of the temperature-sensitive metal layer in a concentric manner, and an induction coil disposed inside the tubular-shaped temperature-sensitive metal layer and adapted to generate a magnetic field. In this fixing roller, the temperature-sensitive metal layer has a thickness t (m) set to satisfy the following inequality:

$$503\times\sqrt{\rho/(\mu s\times f)}<t<503\times\sqrt{\rho/(1\times f)},$$

wherein: ρ is a resistivity of the temperature compensator alloy (Ω·m); f is a frequency (Hz) of a power supply for the induction coil; and μs is a relative permeability of the magnetic shunt alloy at a temperature less than a Curie temperature thereof.

In the above inequality, $503\times\sqrt{\rho/(\mu s\times f)}$ is a magnetic-field penetration depth when the temperature-sensitive metal layer has a temperature less than the Curie temperature (transition temperature), and $503\times\sqrt{\rho/(1\times f)}$ is a magnetic-field penetration depth when the temperature-sensitive metal layer has a temperature equal to or greater than the Curie temperature.

In this fixing roller, when the temperature-sensitive metal layer has a temperature less than the Curie temperature, a magnetic-field penetration depth becomes less than the thickness of the temperature-sensitive metal layer. Thus, a load (electric resistance) to an eddy current generated by the magnetic field is increased (i.e., an eddy current flows through a narrow area at higher density and a load to the eddy current is increased), and thereby a magnetic flux flows through the temperature-sensitive metal layer with a large electric resistance in an axial direction thereof. The increased load to the eddy current will generate a larger quantity of heat (Joule heat) to allow the temperature-sensitive metal layer to be quickly heated up.

Then, when the temperature-sensitive metal layer is heated up to a temperature equal to or greater than the Curie temperature, a magnetic-field penetration depth becomes greater than the thickness of the temperature-sensitive metal layer. Thus, the magnetic field reaches the nonmagnetic metal layer with a lower resistivity than that of the temperature-sensitive metal layer, and a magnetic flux flows through the low-resistivity nonmagnetic metal layer. This makes it possible to reduce a heat generation rate and suppress excess heating of the fixing roller.

As above, this fixing roller has an effect of being able to prevent excess heating thereof without using the aforementioned control intended to suppress excess heating of a fixing roller based on detection of a temperature of the fixing roller using a temperature sensor, such as a thermistor or a thermostat (i.e., without the risk of occurrence of control lag due to output delay of a detection signal).

Just for reference, in the fixing roller disclosed in the Document D2, an alloy of iron (Fe) and nickel (Ni) is used as a material as the temperature-sensitive metal layer, and aluminum (Al) is used as a material of the nonmagnetic metal layer.

However, even in the fixing roller having the temperature-sensitive metal layer made of a given material and a thickness satisfying the above inequality, and the nonmagnetic metal layer made of aluminum (Al) (hereinafter referred to as "aluminum layer"), it does not always mean that no heat generation occur while it is understandable that generation of Joule heat due to an eddy current can be reduced at a lower level, because, when a temperature of the temperature-sensitive metal layer becomes equal to or greater than its Curie temperature according to excitation of the induction coil for a fixing process, a magnetic field penetrates through the temperature-sensitive metal layer, and a magnetic flux flows across the aluminum layer in an axial direction thereof. The "graph showing a relationship between a temperature of the fixing roller and an elapsed time" disclosed in FIG. 6 of the Document D2 shows that a temperature of the fixing roller is continuously increased as time passes.

Thus, the induction heating-type fixing device disclosed in the Document D2 employing the above fixing device still involves a problem that, when the fixing process is continuously performed, the fixing roller will be excessively heated within a relatively short duration of the fixing process, and, in particular, a temperature in a region of the fixing roller except for a central region thereof where heat is released to sheets passing therethrough, or in opposite end regions of the fixing roller except, will be extremely increased.

As measures for solving this problem, it is contemplated to increase the thickness of the aluminum layer or low specific-resistance nonmagnetic metal layer up to a maximum magnetic-field penetration depth in aluminum forming the aluminum layer. The reason is as follows. When the aluminum layer has a thickness equal to or greater than the maximum magnetic-field penetration depth, an eddy-current load (Ω) is determined by the maximum magnetic-field penetration depth. In contrast, when the aluminum layer has a thickness less than the maximum magnetic-field penetration depth, the eddy-current load is varied in inverse proportion to the thickness of the aluminum layer. That is, in this case, if the thickness of the aluminum layer is reduced, the eddy-current load will be increased and thereby a heat generation rate due to Joule heat will be increased to cause difficulty in effectively preventing excess heating of the fixing roller.

In fact, in the invention of the Document D2, the thickness of the aluminum layer is set at 0.7 mm which is far greater than the maximum magnetic-field penetration depth.

However, if the thickness of the aluminum layer is set at a large value of 0.7 mm, the fixing roller will have an excessively large heat capacity in its entirety to raise a new problem about occurrence of a bottleneck in quickly heating up the fixing roller.

SUMMARY OF THE INVENTION

It is an object of the present invention to provide a fixing device capable of achieving a high heat-up speed of a fixing member in an initial heating stage by means of reducing a thickness of a nonmagnetic metal layer of the fixing member to a value fairly less than a magnetic-field penetration depth on the premise that aluminum is used as the nonmagnetic metal, and effectively suppressing excess heating of the fixing roller (particularly, in opposite side regions thereof).

In order to achieve this object, the present invention provides a fixing device comprising a fixing member for fixing a transferred toner image onto a transfer target through a heating process, and a pressing member disposed in contact with the fixing member to define therebetween a nip zone for passing the transfer target therethrough. The fixing member includes a nonmagnetic metal layer made of a nonmagnetic metal, a temperature-sensitive metal layer made of a temperature-sensitive metal, and an induction coil for applying a magnetic field to the nonmagnetic metal layer and the temperature-sensitive metal layer to cause induction heating therein. The temperature-sensitive metal layer is disposed closer to the induction coil than the nonmagnetic metal layer, and the nonmagnetic metal layer is made of aluminum and formed to have a thickness allowing the nonmagnetic metal layer to be substantially free from a temperature rise due to the induction heating.

The present invention further provides an image forming apparatus comprising a transfer section for transferring to a sheet a toner image based on image data, and an image fixing section for fixing the toner image transferred onto a surface of the sheet in the transfer section, to the sheet by means of heat. The image fixing section includes the above fixing device.

In the above fixing device and the image forming apparatus, when the transfer target is fed to the nip zone where the fixing member and pressing member are in contact with one another, the transfer target is heated by the fixing member increased in temperature through induction heating generated by a magnetic field from an induction coil. In this manner, the transfer target can be subjected to a fixing process for melting the transferred toner on the transfer target and fusion-bonding the toner onto the transfer target.

Further, the fixing member may comprise the temperature-sensitive metal layer made of a temperature-sensitive metal and formed on the side of the induction coil, and the nonmagnetic metal layer made of a nonmagnetic metal and laminated on the temperature-sensitive metal layer. Thus, the temperature-sensitive metal layer can be formed to have a thickness greater than a value ($503\times\sqrt{\rho/(\mu\times f)}$) (wherein ρ is a specific resistance (Ω·m) of the temperature compensator alloy: f is a frequency (Hz) of an induction heating power source; and μ is a relative permeability of the temperature-sensitive metal at a temperature less than a Curie temperature) expressing a magnetic-field penetration depth at a temperature less than the Curie temperature, and less than a value ($503\times\sqrt{\rho/(1\times f)}$) expressing a magnetic-field penetration depth. In this case, under the condition of less than the Curie temperature (or in the period where a temperature of the fixing roller is being increased in response to energization of the induction coil), the magnetic flux flows through the temperature-sensitive metal layer so that a quick temperature rise in heating layer can be achieved based on an eddy current generated in the temperature-sensitive metal layer.

Then, when the temperature of the temperature-sensitive metal layer becomes equal to or greater than the Curie temperature, the magnetic-field penetration depth becomes greater than the thickness of the temperature-sensitive metal layer (or $503\times\sqrt{\rho/(1\times f)}$). Thus, the magnetic field passes over the temperature-sensitive metal layer and reaches the nonmagnetic metal layer, and the magnetic flux flows through the nonmagnetic metal layer. Further, the temperature-sensitive metal layer made of aluminum is formed to have a thickness at which substantially no induction-heating-based temperature rise occurs. Thus, as compared with the conventional fixing device where a thickness of the aluminum layer is set at a value approximately equal to a magnetic-field penetration depth, the fixing device can effectively suppress a temperature rise after the fixing device reaches a given temperature, while ensuring a high heat-up rate of the fixing member by means of induction heating.

BRIEF DESCRIPTION OF THE DRAWINGS

FIGS. 5A and 5B are sectional front views schematically showing a fixing member, for the purpose of explaining functions of the present invention, wherein FIG. 5A shows a state when a heating layer has a temperature less than a Curie temperature, and 5B shows a state when the heating layer has a temperature equal to or greater than the Curie temperature.

FIGS. 6A and 6B are schematic explanatory diagrams of a fixing device according to a second embodiment of the present invention, wherein FIG. 6A is a sectional front view showing the fixing device, and FIG. 6B is an enlarged sectional view showing a fixing belt.

DETAILED DESCRIPTION OF THE PREFERRED EMBODIMENTS

Figure 1:
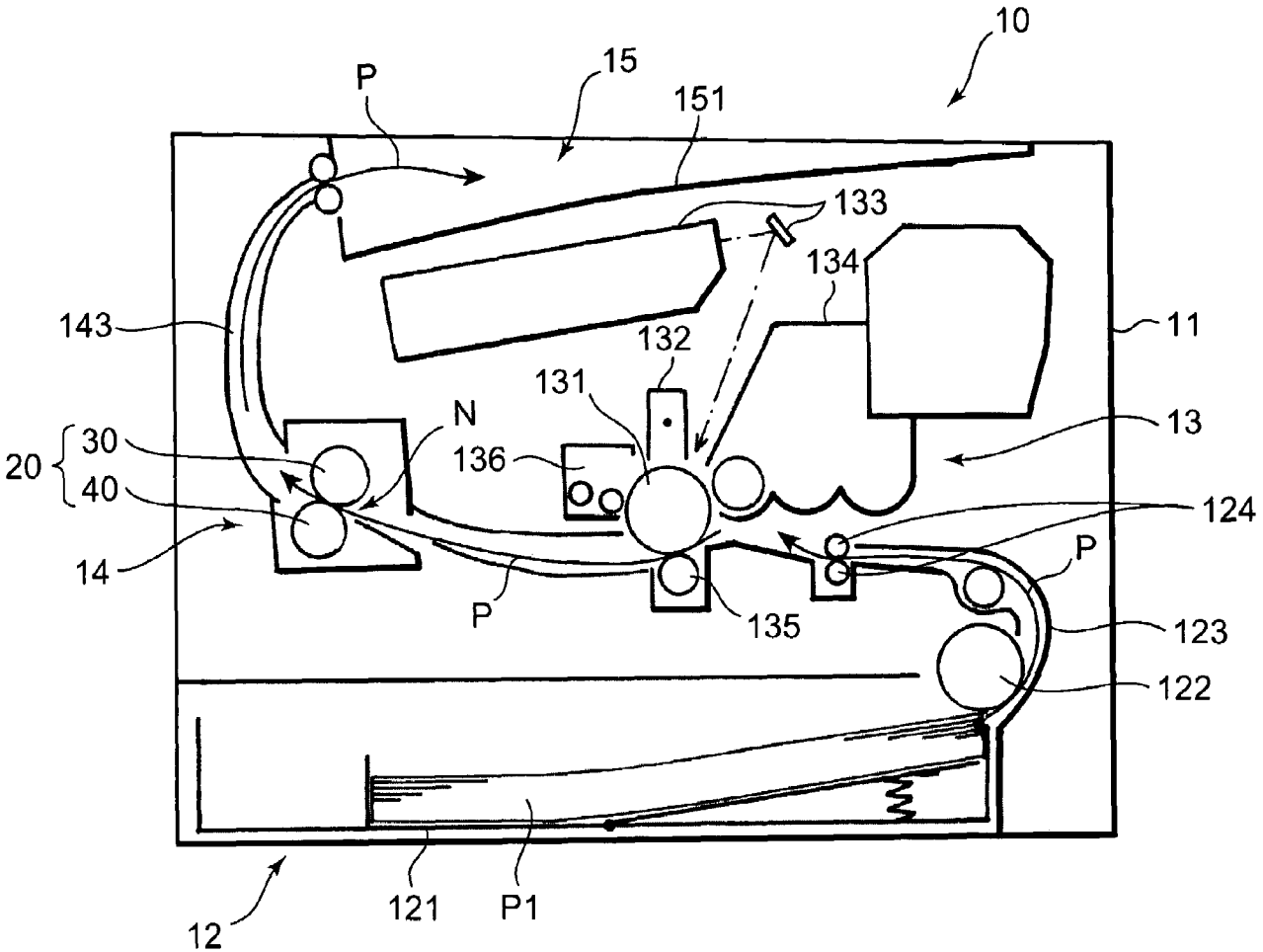
FIG. 1 is an explanatory sectional front view showing an outline of an internal structure of a printer as one example of an image forming apparatus incorporating a fixing device of the present invention.

With reference to FIG. 1, a printer as one example of an image forming apparatus incorporating a fixing device of the present invention. FIG. 1 is a sectional front view showing an outline of an internal structure of the printer. As shown in FIG. 1, the printer (image forming apparatus) 10 comprises a sheet storage section 12 for storing a sheet (transfer target) P to be subjected to a printing process, a transfer section 13 for subjecting the sheet P fed from a sheet stuck P1 stored in the sheet storage section 12, to an image transfer process, on a one-by-one basis, a fixing section 14 for subjecting the sheet P subjected to the transfer process through the transfer section 13, to a fixing process, and a sheet ejection section 15 formed at a top portion of an apparatus body 11 to receive the sheet P subjected to the fixing process through the fixing section 14.

The sheet storage section 12 includes a given number (one in FIG. 1) of sheet cassettes 121 detachably inserted into the apparatus body 11. A pickup roller 122 is disposed at an upstream end (right end in FIG. 1) of the sheet cassette 121 to feed the sheet P from the sheet stack P1 on a one-by-one basis. The sheet P fed out of the sheet cassette 121 based on driving of the pickup roller 122 is fed to the transfer section 13 through a sheet feeding passage 123 and a registration roller pair 124 disposed at a downstream end of the sheet feeding passage 123.

The transfer section 13 is provided as a means to subject the sheet P to the transfer process based on image information transmitted from a computer or the like. A photosensitive drum 131 designed to be rotatable about a drum axis extending a longitudinal direction thereof and disposed to allow the drum axis to extend along a direction perpendicular to the surface of the drawing sheet of FIG. 1. An electrostatic charger 132 is disposed immediately above the photosensitive drums 131, and then a light exposure device 133, an image-development device 134, a transfer roller 135 and a cleaning device 136 are disposed along an outer peripheral surface of the photosensitive drums 131 clockwise in this order.

The photosensitive drum 131 is designed to allow an electrostatic latent image and a toner image corresponding to the toner image to be formed on the outer peripheral surface thereof. For this purpose, the outer peripheral surface of the photosensitive drum 131 is formed with an amorphous silicon layer to allow the photosensitive drum 131 to be provided with an outermost layer suitable for forming these images.

The electrostatic charger device 132 is operable to form a uniform charge layer on the outer peripheral surface of the photosensitive drum 131 which is being rotated clockwise about the drum axis. The electrostatic charger device 132 employed in the printer illustrated in FIG. 1 is a type designed to give charges onto the outer peripheral surface of the photosensitive drum 131 by means of corona discharge. In place of the electrostatic charger device 132 serving as a means to give charges onto the outer peripheral surface of the photosensitive drum 131, an electrostatic charge roller may be employed which has an outer peripheral surface adapted to be brought into contact with the outer peripheral surface of the photosensitive drum 131 so as to give charges onto the outer peripheral surface of the photosensitive drum 131 while being rotationally driven by the photosensitive drum 131.

The light-exposure device 133 is operable to irradiate the outer peripheral surface of the photosensitive drum 131 in a rotating state, with a laser light having intensity varied based on image data transmitted from an external device, such as a computer, so as to eliminate charges in a region of the outer peripheral surface of the photosensitive drum 131 irradiated with the laser light to form an electrostatic latent image on the outer peripheral surface of the photosensitive drum 131.

The image-development device 134 is operable to supply toner onto the outer peripheral surface of the photosensitive drum 131 so as to attach the toner on a region formed as the electrostatic latent image to form a toner image on the outer peripheral surface of the photosensitive drum 131.

The transfer roller 135 is operable to transfer the positively-charged toner image formed on the outer peripheral surface of the photosensitive drum 131, to the sheet P fed to a position immediately below the photosensitive drum 131. The transfer roller 135 is designed to give negative charges having a reverse polarity relative to charges of the toner image, to the sheet P.

Thus, the sheet P reaching the position immediately below the photosensitive drum 131 is pressed and nipped between the transfer roller 135 and the positively-charged photosensitive drum 131, and the toner image on the outer peripheral surface of the photosensitive drum 131 is peeled toward a surface of the negatively-charged sheet P. In this manner, the sheet P is subjected to the transfer process.

The cleaning device 136 is operable to remove toner remaining on the outer peripheral surface of the photosensitive drum 131 after completion of the transfer process, so as to clean the outer peripheral surface of the photosensitive drum 131. The outer peripheral surface of the photosensitive drum 131 cleaned by the cleaning device 136 will be rotated toward the electrostatic-charge device 132 again to perform a next image forming process.

The fixing section 14 serves as a means to heat the toner image on the sheet P subjected to the transfer process through the image forming section 13, so as to subject the sheet P to the fixing process. The fixing section 14 includes a fixing member 30 for giving heat to the sheet P, and a pressing member 40 disposed below the fixing member 30 in opposed relation to the fixing member 30. The sheet P after completion of the transfer process is fed into a nip zone N defined between the fixing member 30 and the pressing member 40, and subjected to the fixing process based on heat from the fixing member 30 obtained during the course of passing through the nip zone N. The sheet P subjected to the fixing process will be ejected to the sheet ejection section 15 through a sheet-ejecting passage 143.

The sheet ejection section 15 is formed by concaving the top portion of the apparatus body 11 to define a concaved depression with a bottom serving as a sheet tray 151 for receiving the ejected sheet P.

Figure 2:
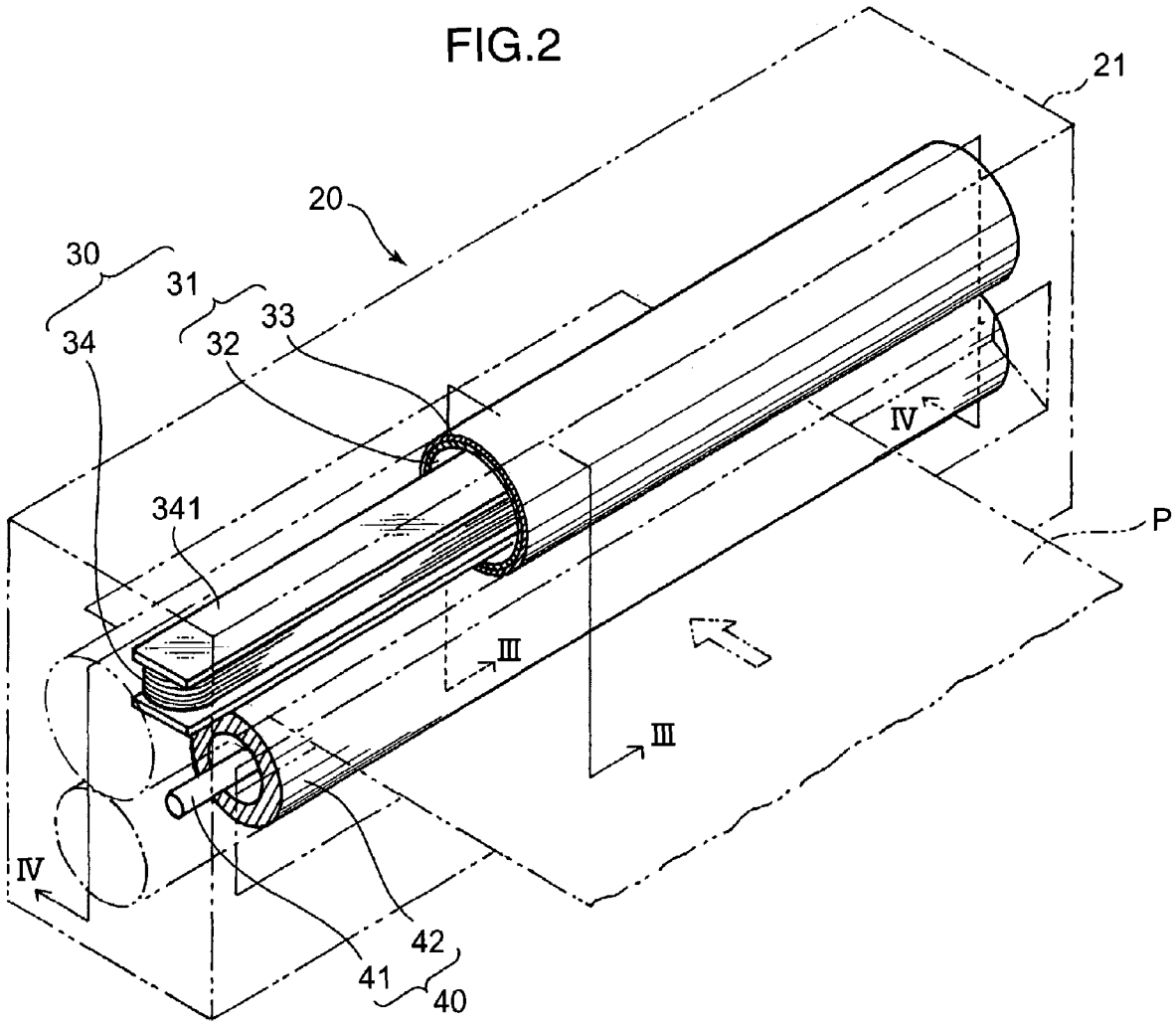
FIG. 2 is a schematic partly cutout perspective view showing a fixing device according to a first embodiment of the present invention.
Figure 3:
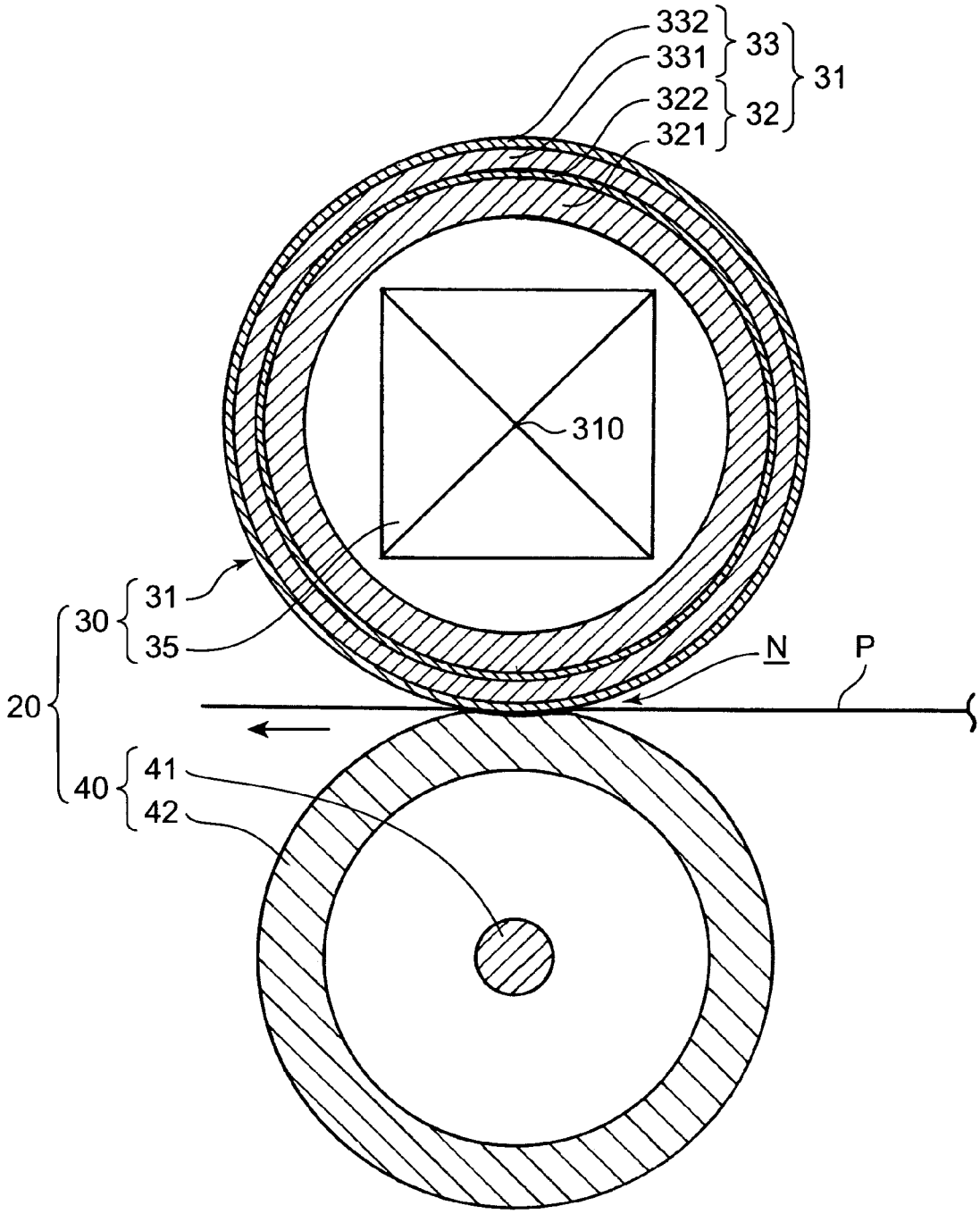
FIG. 3 is a sectional view taken along the line III-III in FIG. 2.
Figure 4:
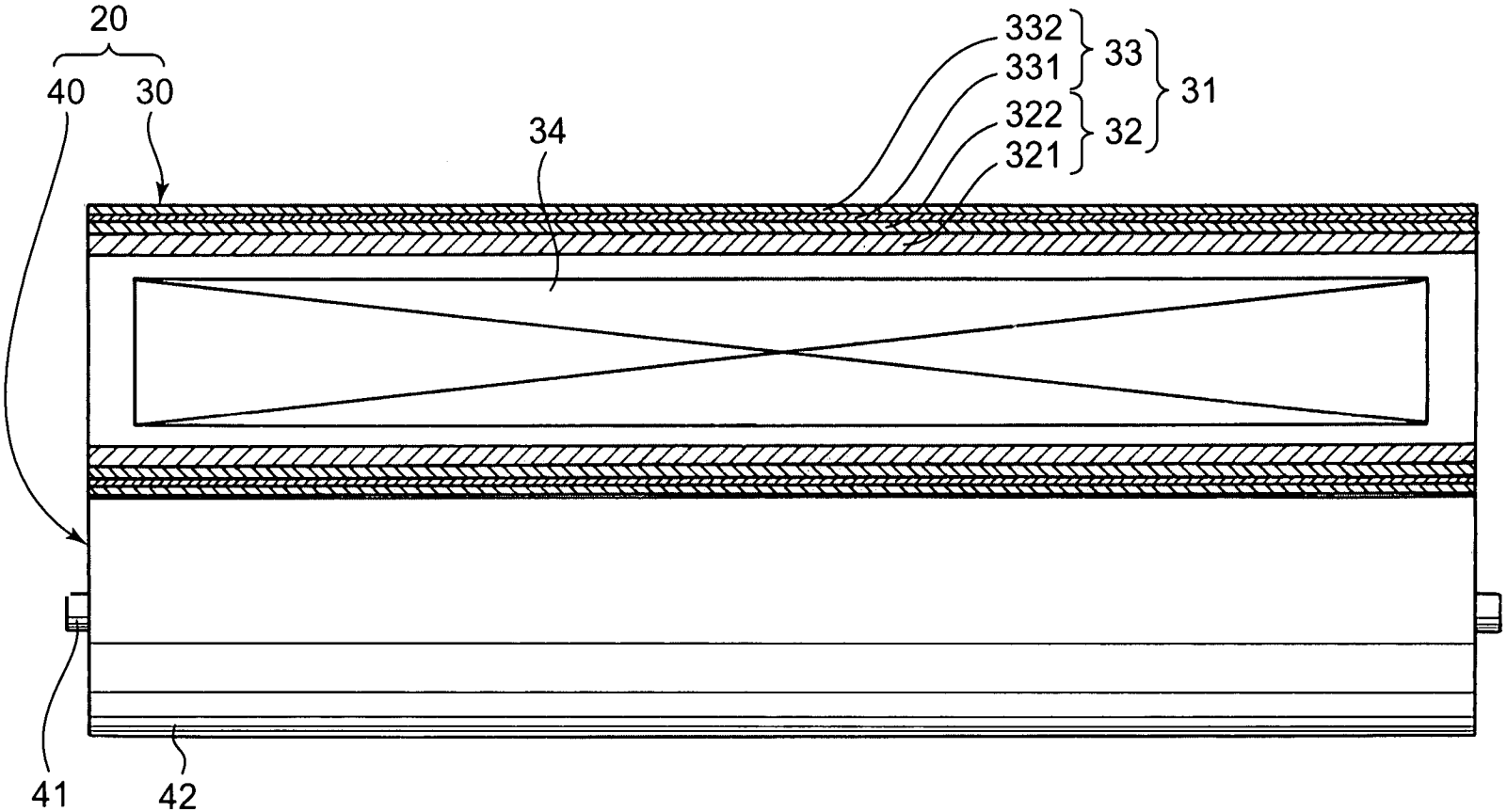
FIG. 4 is a sectional view taken along the line IV-IV in FIG. 2.

FIG. 2 is a schematic partly cutout perspective view showing a fixing device 20 according to a first embodiment of the present invention. FIG. 3 is a sectional view taken along the line III-III in FIG. 2, and FIG. 4 is a sectional view taken along the line IV-IV in FIG. 2. In these figures, each thickness dimension of a fixing roller 31 and a pressing roller 42 is illustrated in an exaggerated manner. As shown in FIG. 2, the fixing device 20 comprises a fixing member 30, a pressing member 40 and a box-shaped housing 21 housing the fixing member 30 and the pressing member 40.

The fixing member 30 includes a tubular-shaped fixing roller 31 disposed in an upper region of an inner space of the housing 21, and an induction coil 34 housed in the fixing roller 31. More specifically, the fixing roller 31 is mounted to an upper portion of the housing 21 rotatably about a tube axis 310 (see FIG. 3) extending in a sheet-width direction orthogonal to a sheet-feeding direction (indicated by the two-dot-chain-lined arrow in FIG. 2). The fixing roller 31 is drivenly rotated clockwise about the tube axis 310 by a driving force of a drive motor (not shown) disposed outside the housing 21. While the fixing member 30 in this embodiment is formed to have an outer diameter of 40 mm, the outer diameter of the fixing member 30 is not limited to 40 mm, but may be set at an optimal value depending on the situation.

The pressing member 40 is disposed in a lower region of the inner space of the housing 21, and in parallel relation to the fixing roller 31 while allowing an outer peripheral surface of the pressing member 40 to be in contact with an outer peripheral surface of the fixing roller 31. The pressing member 40 includes a pressing roller shaft 41 mounted to each of opposite side walls of the housing 21 to extend therebetween in a rotatable manner about an axis thereof, and a pressing roller 42 concentrically supported by the pressing roller shaft 41 in a rotatable manner about the pressing roller shaft 41.

The pressing roller 42 is made of an elastomer, such as elastic silicon rubber. As shown in FIG. 3, the pressing roller 42 is disposed in press contact with the outer peripheral surface of the fixing roller 31, and elastically deformed radially inward. The pressing roller 42 is rotationally driven by the fixing roller 31 rotated of about the tub axis 310. A nip zone Z for passing the sheet P therethrough while nipping the sheet P is defined at a position where the pressing roller 42 is in contact with the fixing roller 31. Thus, a front surface of the sheet P fed from the image forming section 13 in a state when the fixing roller 31 and the pressing roller 42 are rotated, respectively, in opposite directions, is pressed onto the fixing roller 31 by the elastically deformed pressing roller 42, and heated by the fixing roller 31 while passing through the nip zone Z. In this manner, the sheet P is subject to the fixing process for fusion-bonding molten toner onto the front surface of the sheet P.

As shown in FIG. 2, the induction coil 34 is wound along a longitudinal direction of a pair of upper and lower flanges of a core 341 made of a magnetic material and mounted to the fixing roller 31 to extend a longitudinal direction of the fixing roller 31. The fixing device 20 is designed to supply a power to the induction coil 34 from a high-frequency generator circuit (not shown) serving as an induction-heating power source. In response to supplying the induction-heating power to the induction coil 34, lines of magnetic force (magnetic flux) are output from one of the flanges of the core 341 of the induction coil 34. The magnetic flux is flows through the fixing roller 31 toward the other flange of the core 341 of the induction coil 34. This flow of the magnetic flux generates an eddy current in the fixing roller 31, and the fixing roller 31 is heated by Joule heat arising from the eddy current.

The fixing roller 31 includes a heating layer 32 made of a metal (metal layer) and adapted to heat the fixing roller by means of induction heating, and a resin layer 33 laminated around an outer peripheral surface of the heating layer 32. The resin layer 33 is provided as a means to protect the outer peripheral surface of the heating layer 32 and ensure peelability or releasability relative to the sheet P. The resin layer 33 includes an elastic layer 331 made of an elastic material, such as silicon rubber, and a release layer 332 made, for example, of PFA (tetrafluoroethylene-perfluoroalkyl vinyl ether polymer). In this embodiment, the elastic layer 331 is formed to have a thickness of about 100 μm, and the release layer 332 is formed to have a thickness of about 50 μm.

As shown in FIGS. 3 and 4, said heating layer 32 includes an annular-shaped temperature-sensitive metal layer 321 made of a temperature-sensitive metal, and a nonmagnetic metal layer 322 made of a nonmagnetic metal and laminated around an outer peripheral surface of the temperature-sensitive metal layer 321 (the nonmagnetic metal layer 322 corresponds to the metal layer in the Document D2) As used in this specification, the term "temperature-sensitive metal" means a metal having magnetic characteristics to be changed depending on temperatures. In this embodiment, the temperature-sensitive metal layer 321 is made of an alloy of iron (Fe) and nickel (Ni). The temperature-sensitive metal has a property where a magnetic-field penetration depth is changed at a magnetic transition temperature (Curie temperature) as a transition point of magnetic characteristics. In this embodiment, respective composition ratios of iron (Fe) and nickel (Ni) in the alloy are adjusted to set a Curie temperature of the temperature-sensitive metal layer 321 at about 200° C. In the present invention, the above property of the temperature-sensitive metal is utilized to prevent over heating of the fixing roller 31 due to induction heating.

A magnetic-field penetration depth in a temperature-sensitive metal will be described below. At a temperature less than a Curie temperature, a magnetic-field penetration depth a in a temperature-sensitive metal is expressed by the following formula (1):

$$\sigma=503\times\sqrt{\rho/(\mu\times f)} \quad (1),$$

wherein σ is a magnetic-field penetration depth (m); ρ is a specific resistance (Ω·m): f is a frequency (Hz) of an induction heating power source; and μ is a relative permeability at a temperature less than the Curie temperature.

As seen in the formula (1), the magnetic-field penetration depth σ is proportional to a square root of the specific resistance ρ of the temperature-sensitive metal, and inversely proportional to a square root of the relative permeability μ and the induction heating power source frequency f. Thus, in a temperature-sensitive metal, the magnetic-field penetration depth σ is increased as the specific resistance ρ is increased. Further, the magnetic-field penetration depth σ is reduced as the relative permeability μ and the induction heating power source frequency f are increased. Generally, at a temperature less than a Curie temperature, the relative permeability μ is fairly greater than 1.

At a temperature equal to or greater than a Curie temperature, a magnetic-field penetration depth a in a temperature-sensitive metal is expressed by the following formula (2):

$$\sigma=503\times\sqrt{\rho/(1\times f)} \quad (2),$$

wherein σ is a magnetic-field penetration depth (m); ρ is a specific resistance (Ω·m): f is a frequency (Hz) of an induction heating power source; and μ=1 is a relative permeability at a temperature equal to or greater than the Curie temperature.

That is, when a temperature-sensitive metal has a temperature equal to or greater than the Curie temperature, the specific resistance ρ has a minimum value of 1, and thereby the magnetic-field penetration depth σ is increased. In this embodiment, the induction heating power source frequency f is set at 25 kHz.

An eddy current load or a load to an eddy current generated by a magnetic field applied to a metal will be described below. The concept of "eddy current load" is introduced by the inventors for the purpose of adequately describing the present invention. An eddy current load R is expressed by the following formula (3):

$$R=\rho/z \quad (3),$$

wherein R is an eddy current load (Ω); ρ is a specific resistance (Ω·m); and z is a depth in the range of which an eddy current is generated.

That is, the eddy current load R is proportional to the specific resistance ρ of the metal, and inversely proportional to the eddy current generation depth z. Thus, in metals having the same specific resistance ρ, the eddy current load R becomes lower as the eddy current generation depth z is increased.

The eddy current generation depth z is equal to the magnetic-field penetration depth σ in the formulas (1) and (2) (z=σ). Thus, the eddy current load R becomes lower as the magnetic-field penetration depth σ is increased. This means that a thickness of a temperature-sensitive metal can be set at a value greater than the magnetic-field penetration depth σ in the formula (2) to reduce the eddy current load R defined by the formula (3) so that heat generation due to Joule heat generated by an eddy current is limited to a low value (or excess heating of the fixing roller 31 is avoided) even if the temperature-sensitive metal is heated up to a temperature equal to or greater than the Curie temperature. However, this concept leads to substantial increase in thickness of the temperature-sensitive metal 321, which is against the need for reduction in wall thickness of the fixing roller 31.

From this point of view, in the temperature-sensitive metal layer 321 formed to have a thickness less than the eddy current generation depth z (or the magnetic-field penetration depth σ), the eddy current load R is expressed by the following formula (4):

$$R=\rho/d \quad (4),$$

wherein d is a thickness of the temperature-sensitive metal layer (d<z=σ).

That is, the eddy current load R becomes larger as the temperature-sensitive metal layer 321 is reduced in thickness for the purpose of achieving reduction in wall thickness of the fixing roller 31, and resulting increase in Joule heat will make it difficult to effectively prevent over heating of the fixing roller 31. Moreover, a temperature-sensitive metal originally has a relatively large specific resistance. Thus, as long as an eddy current is generated in the temperature-sensitive metal layer 321, a desirable anti-over heating effect cannot be expected.

In the present invention, as shown in FIG. 3, a thickness of the temperature-sensitive metal layer 321 made of an alloy of iron (Fe) and nickel (Ni) is firstly minimized (specifically, the thickness is set at a value slightly greater than the magnetic-field penetration depth σ calculated by the formula (1); in this embodiment, the thickness is set at 250 μm). Then, the nonmagnetic metal layer 322 made of aluminum (Al) as a nonmagnetic metal is laminated around the outer peripheral surface of the temperature-sensitive metal layer 321, and a thickness of the nonmagnetic metal or aluminum layer 322 is set at 50 μm. Based on this concept, when the temperature-sensitive metal layer 321 is heated up to a temperature equal to or greater than a Curie temperature, a magnetic field is introduced into the nonmagnetic metal layer 322 having a relatively low specific resistance to allow a magnetic flux to flow through the nonmagnetic metal layer 322.

Thus, in a state when the heating layer 32 has a temperature equal to or greater than a Curie temperature (specifically, 200° C.), while Joule heat will be generated in the nonmagnetic metal layer 322 having a relatively low specific resistance without generation of Joule heat in the temperature-sensitive metal layer 321 having a relatively large specific resistance, the thickness of the nonmagnetic metal layer 322 is set at 50 μm at which substantially no induction-heating-based temperature rise occurs. This value "50 μm" has been determined through various functional verification tests as a value causing substantially no temperature rise in the fixing roller 31.

In this embodiment, a thickness of the temperature-sensitive metal layer 321 is set at a value ten times greater than a thickness calculated by the formula (1) (about 25 μm). The reason is to adequately maintain a mechanical strength of the temperature-sensitive metal layer 321 so as to allow the fixing roller 31 to serve as a roller.

Figure 5A:
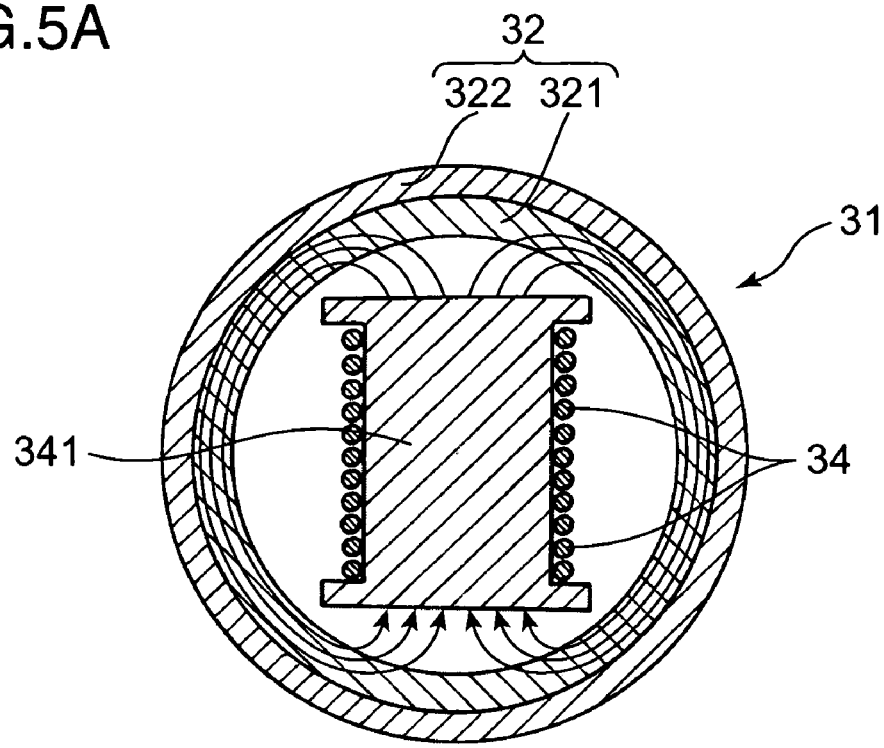
Figure 5B:
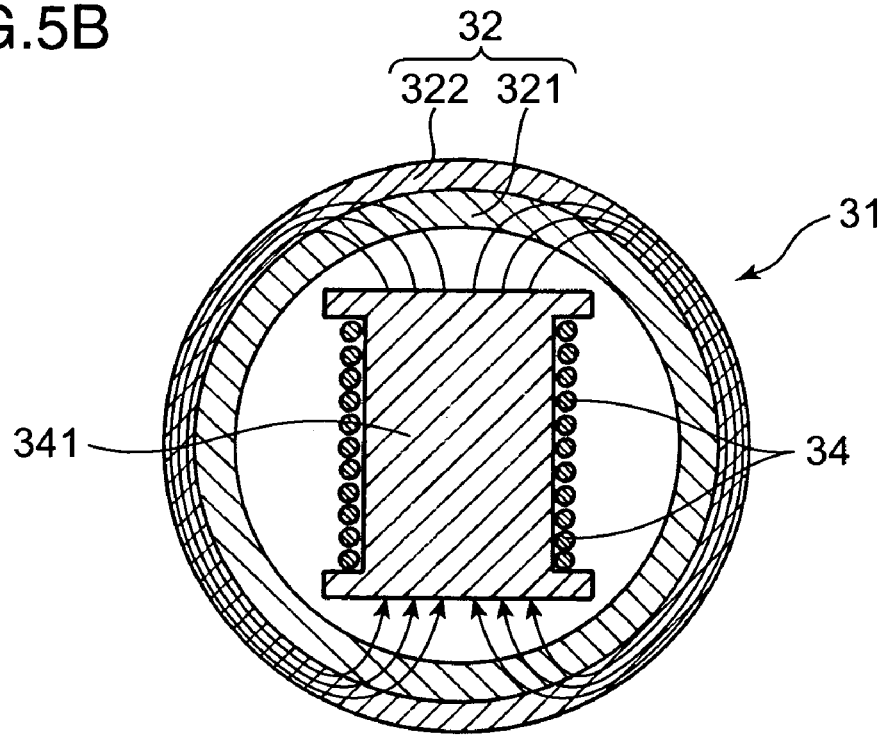

FIG. 5 is a sectional front view schematically showing a fixing member, for the purpose of explaining functions of the present invention, wherein FIG. 5A shows a state when the heating layer 32 has a temperature less than a Curie temperature, and 5B shows a state when the heating layer 32 has a temperature equal to or greater than the Curie temperature. In FIG. 5, the resin layer 33 is not omitted.

In the state of FIG. 5A when the heating layer 32 has a temperature less than the Curie temperature, the penetration depth σ (see the formula (1)) of a magnetic field from the induction coil 34 is not greater than the thickness d of the temperature-sensitive metal layer 321. Thus, the magnetic flux from the induction coil 34 flows through the temperature-sensitive metal layer 321 as indicated by the arrows without reaching the nonmagnetic metal layer 322, to generate Joule heat based on an eddy current generated in the temperature-sensitive metal layer 321 so as to allow the temperature-sensitive metal layer 321 to be quickly heated.

Then, when the temperature of the temperature-sensitive metal layer 321 becomes equal to or greater than 200° C. set as a Curie temperature, the penetration depth σ (see the formula (2)) of the magnetic field from the induction coil 34 becomes greater than the thickness d of the temperature-sensitive metal layer 321. Thus, as shown FIG. 5B, the magnetic flux from the induction coil 34 passes over the temperature-sensitive metal layer 321 and reaches and flows through the nonmagnetic metal layer 322.

In this state, Joule heat based on an eddy current is generated in the nonmagnetic metal layer 322. However, aluminum (Al) with a relatively low specific resistance is used as a nonmagnetic material forming the nonmagnetic metal layer 322, and heating power based on Joule heat is reduced because the magnetic field is concentrated in a region of the nonmagnetic metal layer 322 having a temperature less than the Curie temperature. Further, the power supply to the induction coil 34 is cut off in response to detection of overload by load detection means provided in the high-frequency power supply. This makes it possible to prevent over heating or a problem that the fixing roller 31 is heated up to a temperature fairly greater than the Curie temperature.

Then, when the temperature of the temperature-sensitive metal layer 321 becomes less than 200° C. or Curie temperature, the penetration depth σ of the magnetic field from the induction coil 34 becomes less than the thickness d of the temperature-sensitive metal layer 321 as shown in FIG. 5A. Thus, the temperature-sensitive metal layer 321 is re-heated based on Joule heat.

In this manner, the flow path of the magnetic flux is changed at the Curie temperature, and a cycle of heating and cooling in the fixing roller 31 will be repeated. Thus, a temperature of the fixing roller can be controlled within an allowable range without the need for the feedback control using a temperature sensor. This can also contribute to reduction in cost of the fixing device.

Figure 6A:
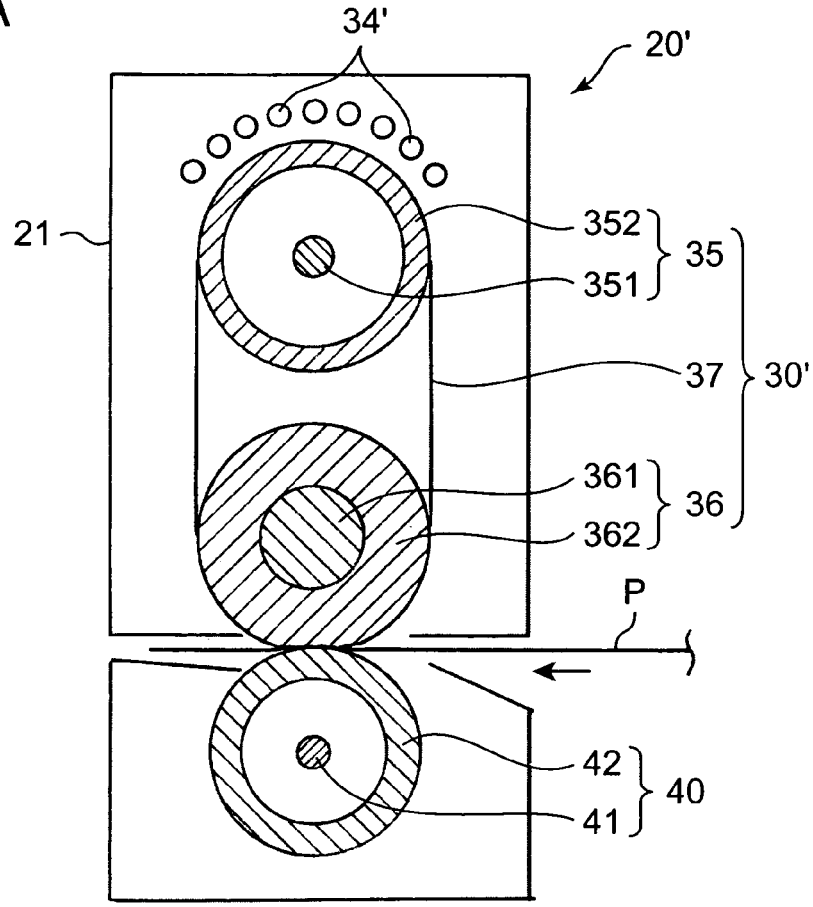
Figure 6B:
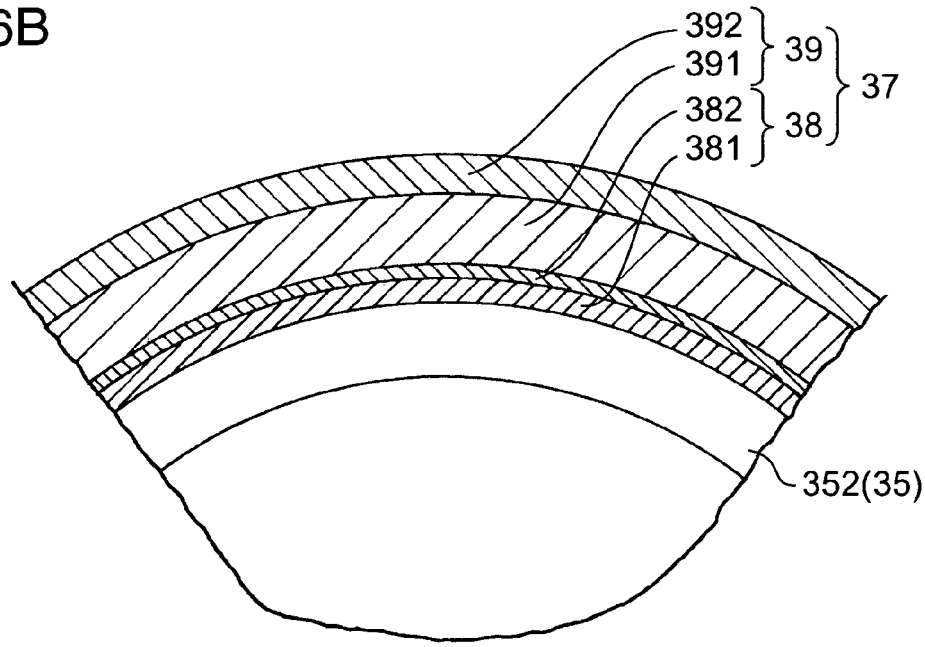

FIG. 6 is a schematic explanatory diagrams of a fixing device 20' according to a second embodiment of the present invention, wherein FIG. 6A is a sectional front view showing the fixing device 20', and FIG. 6B is an enlarged sectional view showing a fixing belt 37. As shown in FIG. 6A, the fixing device 20' according to the second embodiment comprises a fixing member 30' which includes a tension roller (first support roller) 35, a fixing roller (second support roller) 36 disposed below and in opposed relation to the tension roller 35, a fixing belt 37 wound around between the tension roller 35 and the fixing roller 36 in a tensioned manner, and an induction coil 34' disposed above and in opposed relation to the fixing belt 37. The remaining structure of the fixing device 20' is the same as that in the first embodiment.

The tension roller 35 includes a tension roller shaft 351, and a tubular-shaped nonmagnetic metal body 352 formed concentrically around the tension roller shaft 351 and rotatably together with the tension roller shaft 351. The tension roller shaft 351 is drivenly rotated clockwise by a driving force of a drive motor (not shown), and then the nonmagnetic metal body 352 is integrally rotated by the tension roller 351. In this embodiment, the nonmagnetic metal body 352 is made of stainless steel (SUS304) and formed to have a thickness of 0.1 mm.

The fixing roller 36 includes a fixing roller shaft 361 disposed parallel to the tension roller shaft 351 to extend in the same direction as that of the tension roller shaft 351, and a fixing roller body integrally formed on an outer peripheral surface of the fixing roller shaft 361. In this embodiment, the fixing roller body 362 is formed of so-called "silicon sponge" consisting of foamed silicon rubber. The fixing roller body 362 is disposed in press contact with a pressing roller 42, and elastically deformed radially inward.

As shown in FIG. 6B, the fixing belt 37 includes a metal layer 38 formed on the side of an inner surface thereof, and a resin layer 39 laminated on an outer surface of the metal layer 38. The metal layer 38 includes a nonmagnetic metal layer 381 made of aluminum (Al) and formed on the side of an inner surface thereof, and a temperature-sensitive metal layer 382 made of a temperature-sensitive metal consisting of an alloy of iron (Fe) and nickel (Ni) and laminated on an outer peripheral surface of the nonmagnetic metal layer 381. In this embodiment, the nonmagnetic metal layer 381 made of aluminum (Al) is formed to have a thickness of 50 μm, and the temperature-sensitive metal layer 382 is formed to have a thickness of 25 μm slightly greater than the magnetic-field penetration depth σ (24.6 μm) calculated by the formula (1). The nonmagnetic metal layer 381 and the temperature-sensitive metal layer 382 has substantially the same function, respectively, as those of the nonmagnetic metal layer 322 and the temperature-sensitive metal layer 321 in the first embodiment.

The resin layer 39 includes an elastic layer 391 made of silicon rubber, and a release layer 392 made of PFA. The elastic layer 391 has the same thickness (100 μm) as that of the elastic layer 331 in the first embodiment and substantially the same function as that of the elastic layer 331. The release layer 392 has the same thickness (50 μm) as that of the release layer 332 in the first embodiment and substantially the same function as that of the release layer 332.

In the fixing device 20' according to the second embodiment, when the fixing belt 37 is circulatingly moved between the tension roller 35 and the fixing roller 36 by a rotational driving force of the tension roller 35, a magnetic flux is supplied from the induction coil 34' to an outer surface of the fixing belt 37. Therefore, in a state before the metal layer 38 does not reach a Curie temperature (200° C.), the temperature-sensitive metal layer 382 is quickly heated up to the Curie temperature by Joule heat generated by an eddy current.

Thus, when a sheet P is fed to a nip zone N, the sheet P is moved leftward in FIG. 6A while being pressed and nipped between the pressing roller 42 and the fixing belt 37 circulating along the fixing roller body 362 which is elastically deformed. During this movement, the sheet P is subjected to the fixing process based on heat from the fixing belt 37.

Then, when the temperature of the temperature-sensitive metal layer 382 becomes equal to or greater than the Curie temperature, a magnetic field from the induction coil 34' passes over the temperature-sensitive metal layer 382 and reaches the nonmagnetic metal layer 381 having a relatively low specific resistance. Thus, heat based on Joule heat is reduced, and the magnetic field is concentrated in a region of the nonmagnetic metal layer 381 having a temperature less than the Curie temperature. Further, the power supply to the induction coil 34' is cut off in response to load detection in a high-frequency power supply. This makes it possible to prevent over heating of the fixing belt 37. When the fixing belt 37 becomes less than the Curie temperature, the temperature-sensitive metal layer 382 is induction-heated again, and subsequently the temperature of the fixing belt 37 will be varied up and down in an allowable range on the basis of the Curie temperature.

In the second embodiment, a mechanical strength is not required for the fixing belt 37. Thus, the thickness of temperature-sensitive metal layer 382 can be reduced to a lower limit value (25 μm) so as to ensure a high heat-up speed.

As descried above, the fixing device (20, 20') of the present invention comprises a fixing member (30, 30') designed to be heated up by means of induction heating based on a magnetic field from an induction coil (34, 34'), and a pressing member (40) disposed in contact with the fixing member (30, 30') to define a nip zone (N) for passing a sheet (P) therethrough. Thus, when the sheet (P) is fed to the nip zone (N) where the fixing member (30, 30') and the pressing member (40) are in contact with one another, the sheet (P) is heated up by the fixing member (30, 30') increased in temperature through induction heating generated by the magnetic field from an induction coil (34, 34'). In this manner, the sheet P can be subjected to a fixing process for melting transferred toner on the sheet P and fusion-bonding the toner onto the sheet P.

Further, the fixing member (30, 30') comprises a heating layer (32, 38) which includes a temperature-sensitive metal layer (321, 382) made of a temperature-sensitive metal and formed on the side of the induction coil (34, 34') and a nonmagnetic metal layer (322, 381) made of a nonmagnetic metal and laminated on the temperature-sensitive metal layer (321, 382). Thus, the temperature-sensitive metal layer (321, 382) can be formed to have a thickness (d) greater than a value ($\sigma 1=503\times\sqrt{\rho/(\mu\times f)}$) calculated by the formula (1) expressing a magnetic-field penetration depth at a temperature less than the Curie temperature ($d>\sigma 1$) and less than a value ($\sigma 2=503\times\sqrt{\rho/(1\times f)}$) calculated by the formula (2) expressing a magnetic-field penetration depth ($d<\sigma 2$). In this case, under the condition of less than the Curie temperature (or in the period where a temperature of the fixing roller is being increased in response to energization of the induction coil (34, 34')), the magnetic flux flows through the temperature-sensitive metal layer (321, 382) so that a quick temperature rise in heating layer (32, 38) can be achieved based on an eddy current generated in the temperature-sensitive metal layer (321, 382).

Then, when the temperature of the temperature-sensitive metal layer (321, 382) becomes equal to or greater than the Curie temperature, the magnetic-field penetration depth becomes greater than the thickness of the temperature-sensitive metal layer (321, 382). Thus, the magnetic field passes over the temperature-sensitive metal layer (321, 382) and reaches the nonmagnetic metal layer (322, 381), and the magnetic flux flows through the nonmagnetic metal layer having a relatively low specific resistance. Further, the temperature-sensitive metal layer (321, 382) is made of aluminum (Al) having a relatively low specific resistance and formed to have a thickness of 50 μm at which substantially no induction-heating-based temperature rise occurs. Thus, as compared with the conventional fixing device where a thickness of the temperature-sensitive metal layer 322, 381 is set at a value (about 500 μm) approximately equal to a magnetic-field penetration depth, the temperature-sensitive metal layer (321, 382) can contribute to increase in heat-up rate during an initial heating stage of the heating layer (32, 38).

In the first embodiment, the heating layer 32 is used as a component of the tubular-shaped fixing roller 31 designed to be rotatable about the tube axis 310. In this case, the induction coil 34 can be housed in the tubular-shaped fixing roller 31 to achieve reduction in size of the fixing member 30.

In the second embodiment, the heating layer 38 is used as a component of the fixing belt 37 wound around between the tension roller 35 and the fixing roller 36 in a tensioned manner. In this case, a structural strength is not required for the fixing belt 37. Thus, the thickness of temperature-sensitive metal layer 382 can be reduced to a lower limit value so as to achieve a maximized heat-up speed.

The present invention is not limited to the above embodiments, but may include the following modifications.

While the fixing devices according to the above embodiments have been employed in the printer 10 as an image forming apparatus, the image forming apparatus is not limited to the printer 10, but may be a copying machine for transferring onto a sheet P a toner image based on image information scanned by a scanner, or a facsimile machine for transferring onto a sheet P a toner image based on transmitted image information.

In the second embodiment, the fixing belt 37 may be composed only of the temperature-sensitive metal layer 382, and the outer peripheral surface of the tension roller 35 may be formed with a nonmagnetic metal layer made of aluminum (Al) as a nonmagnetic metal. In this structure, the fixing belt 37 composed only of the temperature-sensitive metal layer 382 is circulatingly moved between the tension roller 35 and the fixing roller 36 while being induction-heated based on a magnetic field from the induction coil 34' disposed outside and in opposed relation to the fixing belt 37, and subjects the sheet P to the fixing process in the nip zone Z.

Then, when the fixing belt 37 composed only of the temperature-sensitive metal layer 382 is heated up to a temperature equal to or greater than the Curie temperature the magnetic field from the induction coil 34' passes through the fixing belt 37 and penetrates into the low-resistance aluminum (Al) layer formed on the outer peripheral surface of the tension roller 35.

The above structure where the heating layer 37 is divided into the temperature-sensitive metal layer serving as a single component of the fixing belt 37 and the nonmagnetic metal layer formed on the outer peripheral surface of the tension roller 35 wounded by the fixing belt 37 in a tensioned manner makes it possible to further reduce a thickness of the fixing belt 37 as compared with the heating layer where the temperature-sensitive metal layer and the nonmagnetic metal layer are integrally laminated. This makes it possible to achieve a further increased heat-up rate in the belt-type fixing member 30'. Further, an amount of bending in the fixing belt 37 can be increased. This allows the tension roller 35 and the fixing roller 36 to be reduced in diameter so as to contribute to reduction in size of the fixing device.

The following functional verification test has been conducted to check to what extent the thickness of the nonmagnetic metal layer 322, 381 can be reduced while preventing over heating of the fixing member 30, 30' when aluminum (Al) is used in the nonmagnetic metal layer 322, 381.

Figure 7:
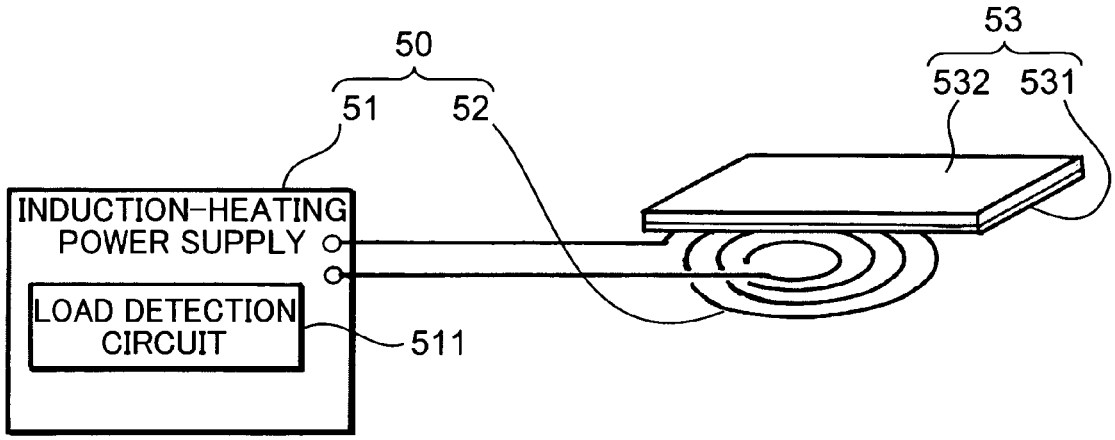
FIG. 7 is a schematic explanatory diagram showing a testing device used in a functional verification test.

FIG. 7 is a schematic explanatory diagram showing a testing device used in the functional verification test. As show in this figure, a testing device 50 comprises an induction-heating power supply 51 internally having a load detection circuit 511, and an induction-heating coil 52 generating high-frequency magnetic field lines by an induction-heating power supplied from the induction-heating power supply 51. This testing device 50 was designed to supply a high-frequency power of 25 kHz from the induction-heating power supply 51 to the induction-heating coil 52.

In the above testing device 50, a test piece 53 was disposed above the induction heating coil 52, and the induction-heating power supply 51 was activated to supply a magnetic field lines to the test piece 53 to check an over-heating suppressive effect.

The test piece 53 was comprised of a temperature-sensitive metal layer 531 made of an alloy of iron (Fe) and nickel (Ni) and formed to have a square shape having a planar dimension of 100 mm×100 mm, and a thickness of 25 μm, and a nonmagnetic metal layer 532 made of aluminum (Al) and laminated onto the temperature-sensitive metal layer 531. As to the nonmagnetic metal layer 532, six types having different thicknesses of 10 μm, 20 μm, 30 μm, 40 μm, 50 μm and 60 μm was prepared. Each of the six type of test pieces 53 was induction-heated, and it was determined whether a temperature-rise suppressive effect is observed when a detection result of the load detection circuit 511 on a load of the test piece 53 (load of the temperature-sensitive metal layer 531) becomes less than 30%. The reason for using "30%" as a criterion is as follows. Through actual test results using various types of fixing devices, it was verified that a heat generation rate based on induction heating at a load of about 30% is in well-balanced relation to a heat release value in an actual fixing device 20, and the fixing roller 31 is not heated up to a temperature fairly greater than a Curie temperature (about 200° C. in this embodiment) at the load 30%. The test result is shown in Table 1.

TABLE 1

| Test Result | | | | | | | |
|---|---|---|---|---|---|---|---|
| Conditions | Thickness of temperature-sensitive metal layer (μm) | 25 | | | | | |
| | Thickness of nonmagnetic metal layer (aluminum) (μm) | 10 | 20 | 30 | 40 | 50 | 60 |
| Test Result | | X | X | X | X | ○ | ○ |

Note)
○: Temperature-rise suppressive effect was observed
X: No temperature-rise suppressive effect was observed As shown in Table 1, a temperature-rise suppressive effect is observed when the nonmagnetic metal layer 532 has a thickness of 50 μm or more. Through this test, it could be verified that, when aluminum is used as the temperature-sensitive metal layer 531, over heating of the fixing member 30, 30' can be prevented by setting a thickness of the nonmagnetic metal layer 532 at 50 μm or more.

This application is based on patent application No. 2005-089175 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device comprising:

a fixing member for fixing a transferred toner image onto a transfer target through a heating process; and a pressing member disposed in contact with said fixing member to define therebetween a nip zone for passing the transfer target therethrough, wherein said fixing member includes:

a nonmagnetic metal layer made of a nonmagnetic metal;

a temperature-sensitive metal layer made of a temperature-sensitive metal; and an induction coil for applying a magnetic field to said nonmagnetic metal layer and said temperature-sensitive metal layer to cause induction heating therein, wherein:

said temperature-sensitive metal layer is disposed closer to said induction coil than said nonmagnetic metal layer;

said nonmagnetic metal layer is made of aluminum and formed to have a thickness allowing said nonmagnetic metal layer to be substantially free from a temperature rise due to said induction heating; and a lower limit value of the thickness of said nonmagnetic metal layer is set at 50 μm.

2. The fixing device as defined in claim 1, wherein said nonmagnetic metal layer and said temperature-sensitive metal layer are laminated in adjacent relation to one another to form a composite metal layer, wherein said temperature-sensitive metal layer is formed in a composite metal layer on the side of said induction coil, and said nonmagnetic metal layer laminated onto said temperature-sensitive metal layer on the other side.

3. The fixing device as defined in claim 2, wherein said composite metal layer is formed to have a tubular shape.

4. The fixing device as defined in claim 3, wherein said composite metal layer is formed in a fixing roller designed to be rotatable about a tube axis of said composite metal layer.

5. The fixing device as defined in claim 4, wherein:

said induction coil is disposed within said fixing roller; and said temperature-sensitive metal layer and said nonmagnetic metal layer in said composite metal layer are laminated in such a manner that said temperature-sensitive metal layer and said nonmagnetic metal are disposed, respectively, on the inner side and on the outer side of said composite metal layer.

6. The fixing device as defined in claim 3, wherein said composite metal layer is formed in a fixing belt designed to be circulatingly movable.

7. The fixing device as defined in claim 6, wherein:

said induction coil is disposed outside said fixing belt; and said temperature-sensitive metal layer and said nonmagnetic metal layer in said composite metal layer are laminated in such a manner that said temperature-sensitive metal layer and said nonmagnetic metal are disposed, respectively, on the outer side and on the inner side of said composite metal layer.

8. The fixing device as defined in claim 1, wherein each of said nonmagnetic metal layer and said temperature-sensitive metal layer is formed in a different member.

9. The fixing device as defined in claim 8, wherein said fixing member includes a fixing belt wound around a pair of first and second support rollers in a tensioned manner, wherein:

said temperature-sensitive metal layer is formed in said fixing belt;

said nonmagnetic metal layer is formed in an outer peripheral surface of said first support rollers; and said induction coil is disposed in opposed relation to the outer peripheral surface of said first support roller through said fixing belt.

10. An image forming apparatus comprising:

a transfer section for transferring to a sheet a toner image based on image data; and an image fixing section for fixing the toner image transferred onto a surface of the sheet in said transfer section, to said sheet by means of heat, said image fixing section including:

a fixing member for fixing a transferred toner image onto a sheet through a heating process;

a pressing member disposed in contact with said fixing member to define therebetween a nip zone for passing the sheet therethrough, wherein said fixing member includes:

a nonmagnetic metal layer made of a nonmagnetic metal;

a temperature-sensitive metal layer made of a temperature-sensitive metal; and an induction coil for applying a magnetic field to said nonmagnetic metal layer and said temperature-sensitive metal layer to cause induction heating therein, wherein:

said temperature-sensitive metal layer is disposed closer to said induction coil than said nonmagnetic metal layer;

said nonmagnetic metal layer is made of aluminum and formed to have a thickness allowing said nonmagnetic metal layer to be substantially free from a temperature rise due to said induction heating; and a lower limit value of the thickness of said nonmagnetic metal layer is set at 50 μm.

11. The image forming apparatus as defined in claim 10, wherein said nonmagnetic metal layer and said temperature-sensitive metal layer are laminated in adjacent relation to one another to form a composite metal layer, wherein said temperature-sensitive metal layer is formed in a composite metal layer on the side of said induction coil, and said nonmagnetic metal layer laminated onto said temperature-sensitive metal layer on the other side.

12. The image forming apparatus as defined in claim 11, wherein said composite metal layer is formed to have a tubular shape.

13. The image forming apparatus as defined in claim 12, wherein said composite metal layer is formed in a fixing roller designed to be rotatable about a tube axis of said composite metal layer.

14. The image forming apparatus as defined in claim 13, wherein:

said induction coil is disposed within said fixing roller; and said temperature-sensitive metal layer and said nonmagnetic metal layer in said composite metal layer are laminated in such a manner that said temperature-sensitive metal layer and said nonmagnetic metal are disposed, respectively, on the inner side and on the outer side of said composite metal layer.

15. The image forming apparatus as defined in claim 12, wherein said composite metal layer is formed in a fixing belt designed to be circulatingly movable.

16. The image forming apparatus as defined in claim 15, wherein:

said induction coil is disposed outside said fixing belt; and said temperature-sensitive metal layer and said nonmagnetic metal layer in said composite metal layer are laminated in such a manner that said temperature-sensitive metal layer and said nonmagnetic metal are disposed, respectively, on the outer side and on the inner side of said composite metal layer.

17. The image forming apparatus as defined in claim 10, wherein each of said nonmagnetic metal layer and said temperature-sensitive metal layer is formed in a different member.

18. The image forming apparatus as defined in claim 17, wherein said fixing member includes a fixing belt wound around a pair of first and second support rollers in a tensioned manner, wherein:

said temperature-sensitive metal layer is formed in said fixing belt;

said nonmagnetic metal layer is formed in an outer peripheral surface of said first support rollers; and said induction coil is disposed in opposed relation to the outer peripheral surface of said first support roller through said fixing belt.

19. The fixing device as defined in claim 10, wherein an upper limit value of the thickness of said nonmagnetic material layer is set at 60 μm.

20. A fixing device comprising:

a fixing member for fixing a transferred toner image onto a transfer target through a heating process; and a pressing member disposed in contact with said fixing member to define therebetween a nip zone for passing the transfer target therethrough, wherein said fixing member includes:

a nonmagnetic metal layer made of a nonmagnetic metal;

a temperature-sensitive metal layer made of a temperature-sensitive metal; and an induction coil for applying a magnetic field to said nonmagnetic metal layer and said temperature-sensitive metal layer to cause induction heating therein, wherein:

said temperature-sensitive metal layer is disposed closer to said induction coil than said nonmagnetic metal layer; and said nonmagnetic metal layer is made of aluminum and formed to have a thickness of 50 to 60 μm so as to allow said nonmagnetic metal layer to be substantially free from a temperature rise due to said induction heating.

21. A fixing device comprising:

a fixing member for fixing a transferred toner image onto a transfer target through a heating process; and a pressing member disposed in contact with said fixing member to define therebetween a nip zone for passing the transfer target therethrough, wherein said fixing member includes:

a nonmagnetic metal layer made of a nonmagnetic metal;

a temperature-sensitive metal layer made of a temperature-sensitive metal; and an induction coil for applying a magnetic field to said nonmagnetic metal layer and said temperature-sensitive metal layer to cause induction heating therein, wherein:

said temperature-sensitive metal layer is disposed closer to said induction coil than said nonmagnetic metal layer; and said nonmagnetic metal layer is made of aluminum and formed to have a thickness of about one-tenth of a magnetic-field penetration depth so as to allow said nonmagnetic metal layer to be substantially free from a temperature rise due to said induction heating.

* * * * *